US006909416B2

(12) United States Patent
Aoki

(10) Patent No.: US 6,909,416 B2
(45) Date of Patent: Jun. 21, 2005

(54) DISPLAY DEVICE DRIVER IC

(75) Inventor: Tadashi Aoki, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 10/251,972

(22) Filed: Sep. 23, 2002

(65) Prior Publication Data

US 2003/0052849 A1 Mar. 20, 2003

Related U.S. Application Data

(62) Division of application No. 09/362,054, filed on Jul. 28, 1999, now Pat. No. 6,489,940.

(30) Foreign Application Priority Data

Jul. 31, 1998 (JP) ..... 10-218325

(51) Int. Cl.[7] ..... G09G 3/36
(52) U.S. Cl. ..... 345/93; 345/204; 345/87
(58) Field of Search ..... 345/87, 90, 91, 345/93, 94, 98, 100, 204

(56) References Cited

U.S. PATENT DOCUMENTS

| | | | | |
|---|---|---|---|---|
| 4,511,926 | A | 4/1985 | Crossland et al. | 345/99 |
| 4,904,895 | A | 2/1990 | Tsukamoto et al. | 313/336 |
| 5,124,695 | A | 6/1992 | Green | 345/103 |
| 5,721,835 | A | 2/1998 | Niwa et al. | 395/281 |
| 5,742,269 | A | 4/1998 | Hayashiguchi et al. | 345/87 |
| 5,801,673 | A | 9/1998 | Shimada et al. | 345/100 |
| 6,118,424 | A | 9/2000 | Suzuki | 345/100 |

FOREIGN PATENT DOCUMENTS

| | | |
|---|---|---|
| JP | 64-031332 | 2/1989 |
| JP | 05-041166 | 2/1993 |

*Primary Examiner*—Bipin Shalwala
*Assistant Examiner*—Ricardo Osorio
(74) *Attorney, Agent, or Firm*—Fitzpatrick, Cella, Harper & Scinto

(57) ABSTRACT

A driver IC (integrated circuit) for a display device allowing simple designing and production and yet capable of obviating display quality difference is provided. The driver IC includes a plurality of drive signal output terminals arrange to have variable drive capacities which vary depending on loads of respective signal electrodes of the display device to which the output terminals are connected so as to supply the respective signal electrodes of the display device with drive signal waveforms having identical time constant. The driver IC preferably includes a number of juxtaposed transistors corresponding to but larger in number than the drive signal output terminals, wherein the respective drive signal output terminals are connected to prescribed numbers of transistors so as to have different drive capacities depending on loads of the signal electrodes of the display device to which the output terminals are connected.

3 Claims, 20 Drawing Sheets

DISPLAY DEVICE DRIVER IC

This application is a division of application Ser. No. 09/362,054, filed Jul. 28, 1999, now U.S. Pat. No. 6,489, 940.

FIELD OF THE INVENTION AND RELATED ART

The present invention relates to a display device driver IC (i.e., an integrated circuit for driving a display device) for applying drive signals to electrodes of a display device, and particularly a liquid crystal device driver IC having drive signal output terminals having improved drive performances.

Hitherto, for driving a liquid crystal device having electrodes arranged in a matrix form, a driver IC for supplying drive signals to the electrodes is designed to have a plurality of terminals having equal drive capacities.

Incidentally, the drive of a liquid crystal panel comprising matrix electrodes as an example of conventional liquid crystal device along a signal electrode (a scanning electrode or a data electrode) constituting the matrix electrodes is electrically equivalently represented by a ladder circuit as shown in FIG. 16. Now, if the resistance and capacitance per unit length of the matrix electrode or signal electrode are denoted by r and c, respectively, and the overall resistance and capacitance along the matrix electrode are denoted by R and C, respectively, a voltage waveform V appearing at a point B in response to a voltage input $V_0$ applied to a point A of the ladder circuit is given as a solution of the following partial differential formula:

$$\frac{\partial^2 V}{\partial x^2} = rc\frac{\partial V_0}{\partial t}.$$

The solution is expressed as follows.

$$\frac{V}{V_0} = -\frac{4}{\pi}\sum_{n=0}^{\infty}\frac{(-1)^n}{2\pi+1}\exp(-((2n+1)\pi/2)^2 t/CR)$$

$$= 1 - \frac{4}{\pi}\left(\left(\exp\left(-\frac{\pi^2 t}{4CR}\right) - \frac{1}{3}\exp\left(\frac{3\pi^2 t}{4CR}\right) + \ldots\right.\right.$$

The above formula provides plots of relative voltage $V/V_0$ versus time (on a scale of time constant CR) as shown in FIG. 17.

Now, in a region of t>CR, the second term and so on can be negligible as sufficiently small, so that a time $t_0$ in which voltage response reaches 90% of the input ($V/V_0$=0.9) can be approximately represented by the following equation:

$$\frac{V}{V_0} = 0.9 = 1 - \frac{4}{\pi}\exp\left(-\frac{\pi^2 t_0}{4CR}\right)$$

The above equation can be converted as follows:

$$0.1=(4/\pi)\cdot\exp(-\pi^2 t_0/4CR)$$

$$\pi/40=\exp(-\pi^2 t_0/4CR).$$

By taking natural logarithm of both sides, $$\ln(\pi/40)=-\pi^2 t_0/4CR$$

$$t_0=-(4/\pi^2)\ln(\pi/40)\cdot CR.$$

As $-(4/\pi^2)$=ca. −41, and $$\ln(\pi/40)=ca.-2.5,$$

the above equation is reduced to $$t_0=ca.CR.$$

Thus, a time $t_0$ in which a voltage output at the remotest point rises up to 90% of the input voltage, i.e., a 0–90% time constant can be expressed by a product of the wiring resistance (R) and the capacitance (C).

The above calculation is based on an assumption that the drive capacity of a driver IC is infinitely large, but the drive capacity of an actual driver IC is limited, so that the time constant, i.e., a rise time, depends on the capacity.

A driver IC has an on-resistance which varies depending on operation points so that the drive capacity exhibits a non-linear characteristic. However, in order to obtain a time constant of drive waveform, the drive capacity is generally approximated as a linear characteristic based on a constant on-resistance Ron.

Accordingly, a 0–90% time constant $t_{0\text{-}90}$ when a panel represented by the equivalent circuit shown in FIG. 16 is driven by a diver IC having an on-resistance Ron is calculated as follows.

$$t_{0\text{-}90}=C(R+Ron).$$

Incidentally, a driver IC is designed to have an on-resistance Ron so that the 0–90% time constant $t_{0\text{-}90}$ satisfies a required standard.

Conventionally, driver ICs 40 for driving a panel having matrix electrodes including data signal electrodes S and scanning signal electrodes C as shown in FIG. 18 have been designed to have equal on-resistances Ron at the respective drive signal output terminals. This is because loads determined by a combination of capacitances along data signal electrodes S or scanning signal electrodes C with wiring resistances are equal for the respective data signal electrodes and for the respective scanning signal electrodes.

Further, as the capacitances and wiring resistances of the data signal electrodes S and the scanning signal electrodes C respectively vary depending on pixel arrangements and sizes of respective panels, the driver ICs 40 have been designed and produced for each panel having a difference pixel arrangement.

On the other hand, in the case of a liquid crystal device including electrodes of different widths for realizing areal gradational display as shown in FIG. 19, electrodes S1 and S2 having different widths have mutually different capacitances and wiring resistances (and also electrodes C1 and C2 do).

Now, drive voltage responses are considered when such electrodes having different widths are supplied with drive signals from driver ICs 40 having equal capacities. For example, when a scanning electrode C1 of a narrower width having a capacitance CS and a resistance RS is driven by a driver IC 40 having an on-resistance Ron as shown in FIG. 20, the response at the remotest point from the IC 40 results in a waveform as shown in FIG. 21. On the other hand, when a scanning electrode of a broader width having a capacitance 4CS and a resistance RS/4 is driven by a driver IC 40 having also an on-resistance Ron as shown in FIG. 22, the response at the remotest point from the IC 40 results in a waveform as shown in FIG. 23.

The 0–90% time constant $Ta_{0\text{-}90}$ and $Tb_{0\text{-}90}$ in the drive waveforms shown in FIGS. 21 and 23, respectively, approximately calculated as follows:

$$Ta_{0\text{-}90}=CS\times(Ron+RS)=CS\cdot Ron+CS\cdot RS$$

$$Tb_{0\text{-}90}=4CS\times(Ron+RS/4)=4CS\cdot Ron+CS\cdot RS$$

$$\therefore Tb-Ta=3CS\cdot Ron$$

Thus, the drive of a broader electrode C2 requires a response time (rise time or fall time) which is longer by 3CS·Ron than the drive of a narrower electrode C1.

As a result, the energies applied to the liquid crystal via a broader electrode and a narrower electrode can be different from each other, resulting in a substantial difference in picture display quality.

On the other hand, as picture display quality can be degraded also in case where a smaller energy is applied to a liquid crystal, the on-resistance of driver ICs for driving electrodes of different widths is set to be suitable for driving electrodes of broader electrodes. In such a case of using driver ICs having an on-resistance Ron suitable for a broader electrode, however, there are liable to cause difficulties in drive of a narrower electrode, such as a larger current flow through the narrower electrodes resulting in fluctuation of power supply potential or ground potential for the liquid crystal device, occurrence of radiation noise, heat generation and increase in current consumption.

Further, in designing and production of driver ICs, an additional area is required for output transistors and is liable to occupy the largest area on a chip, so that a larger semiconductor chip is required to incur a cost increase.

In order to obviate difficulties, such as a lowering in picture display quality, fluctuation of power supply potential or ground potential, occurrence of radiation noise, heat generation and an electric current consumption, the drive capacities of driver ICs have to be optimized, so that development of driver ICs has been effected for each panel size.

As a result, designing and development of a diversity of driver ICs have been required so as to comply with a diversity of display panels requiring special driver ICs exclusively designed and developed therefor, thus having incurred increases in period and cost for development.

SUMMARY OF THE INVENTION

In view of the above-mentioned problems of the prior art, a principal object of the present invention is to provide a display device driver IC allowing simple designing and development and yet capable of preventing an occurrence of fluctuation in display quality.

According to the present invention, there is provided a driver IC (integrated circuit) for supplying drive signals to a plurality of signal electrodes of a display device for driving the display device, wherein said driver IC comprises a plurality of drive signal output terminals having drive capacities which vary depending on loads of respective signal electrodes of the display device to which the output terminals are connected so as to supply the respective signal electrodes of the display device with drive signal waveforms having identical time constant.

According to another aspect of the present invention, there is provided a driver IC for supplying drive signals to a plurality of signal electrodes of a display device for driving the display device, wherein said driver IC comprises a plurality of drive signal output terminals arrange to have variable drive capacities which vary depending on loads of respective signal electrodes of the display device to which the output terminals are connected so as to supply the respective signal electrodes of the display device with drive signal waveforms having identical time constant.

Preferably, the driver IC are designed to include a number of juxtaposed transistors corresponding to but larger in number than the drive signal output terminals, and the respective drive signal output terminals are connected to prescribed numbers of transistors so as to have different drive capacities depending on loads of the signal electrodes of the display device to which the output terminals are connected.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First of all, a structure of a liquid crystal device as an example of display device suitable to be driven by a driver IC according to the present invention is described.

Figure 30:
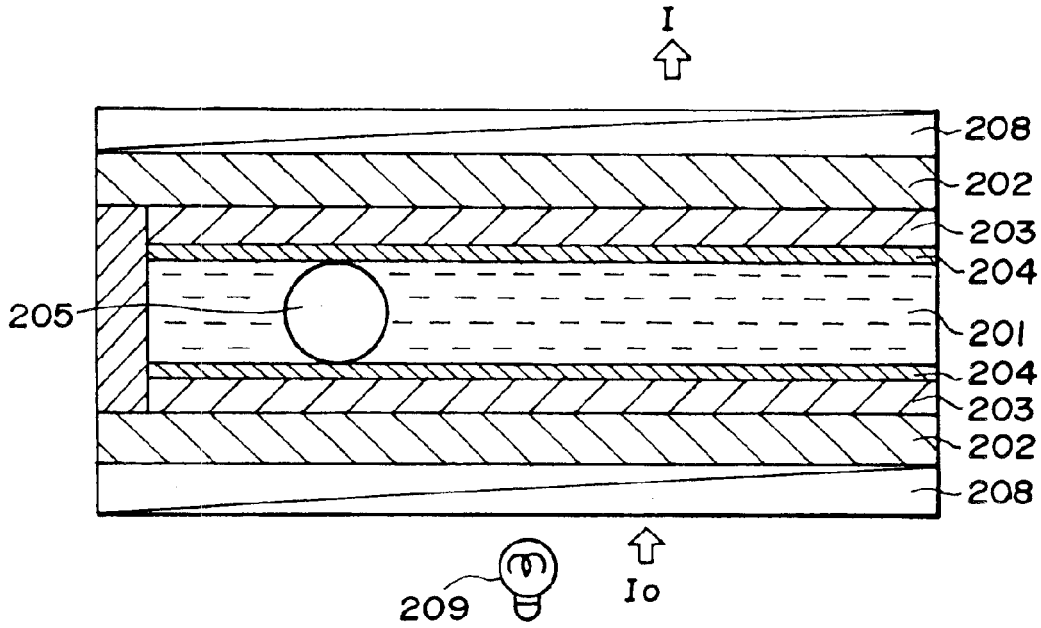
FIG. 30 is a schematic sectional view of a liquid crystal device showing a laminar structure adopted in such a liquid crystal device.

FIG. 30 is a sectional view of such a liquid crystal device. Referring to FIG. 30, the liquid crystal device includes a liquid crystal layer 1 comprising, e.g., a nematic or chiral smectic liquid crystal composition, preferably a chiral smectic liquid crystal composition disposed in a thickness of at most 5 $\mu$m so as to exhibit surface-stabilized bistability according to a model taught by Clark and Lagerwall. Such a liquid crystal layer 201 is disposed between a pair of substrates 202 having thereon on opposing electrodes 203 at least one of which is provided in a plurality so as to form a matrix of electrodes and also alignment film(s) 204. The substrates 202 are formed of a transparent material, such as glass or plastic sheet. The alignment film(s) 204 formed of, e.g., polyimide, a coupling agent or silicon oxide, may be disposed to align the liquid crystal 201 in an alignment state suitable for an intended drive mode. The spacing between the pair of substrates 202 is determined by spacer beads 205 disposed therebetween to also determine the liquid crystal layer thickness, thus providing a liquid crystal cell structure, which is sandwiched between a pair of polarizers 208 to provide a liquid crystal device to be illuminate with a light source 207.

In addition to the above-mentioned alignment film(s) 204, it is possible to dispose an insulating layer for preventing a short circuit between the electrodes on the pair of substrates, and also another organic or inorganic layer. The spacer 205 may be composed of, e.g., silica beads. The liquid crystal device can be driven based on switching signals supplied from signal sources (not shown and will be described with reference to FIG. 1). The transparent electrodes 203 may be arranged to form a matrix so as to allow a pattern display or pattern exposure, thereby providing a display for a personal computer, a work station, etc., or a light valve for a printer, etc.

Figure 1:
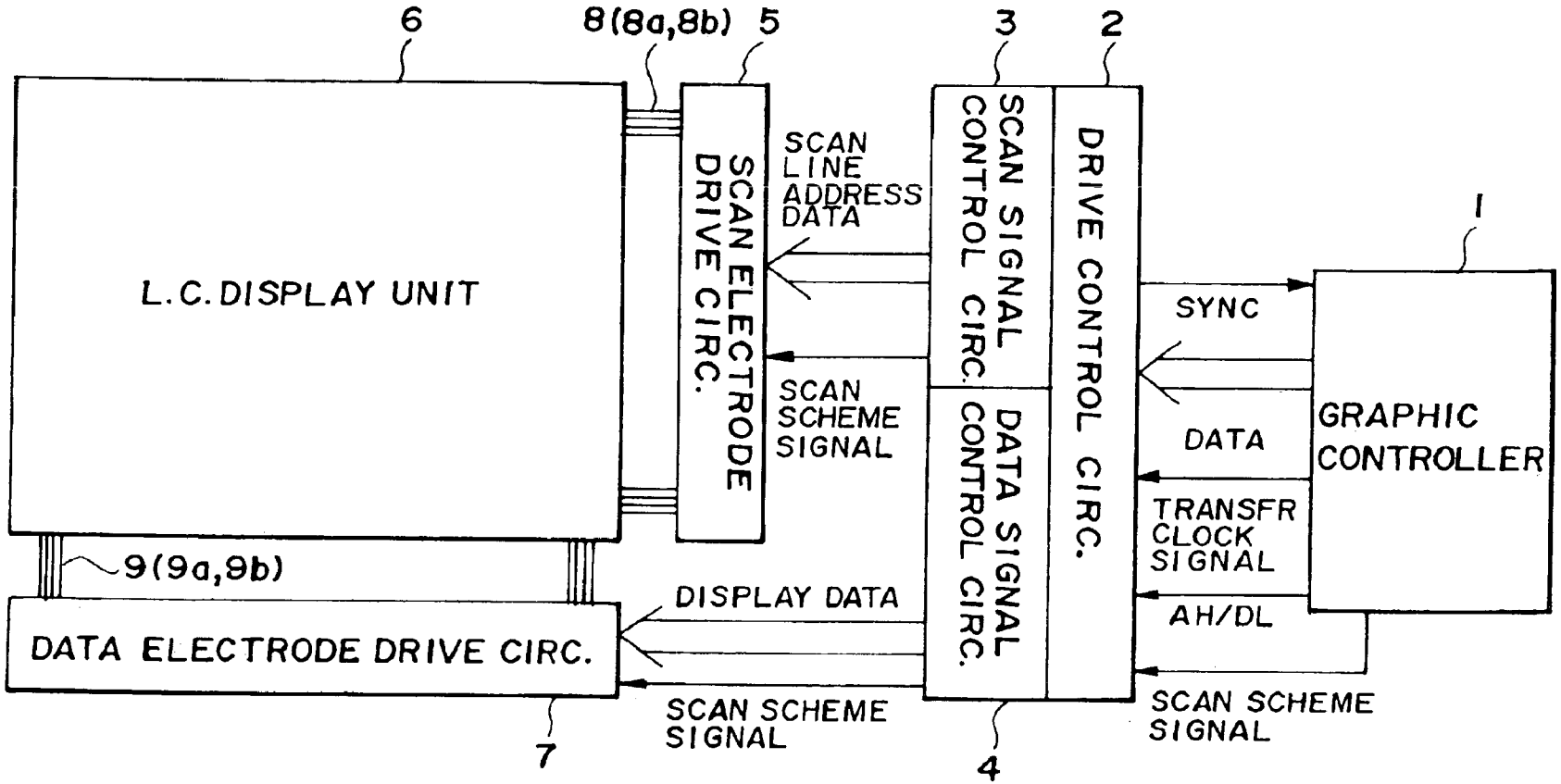
FIG. 1 is a block diagram of a liquid crystal apparatus including a liquid crystal display unit as an example of display device to which the invention is suitably applicable.

Such a liquid crystal device as described with reference to FIG. 30 may be included as a liquid crystal display panel or display unit 6 in a liquid crystal display apparatus as represented by a block diagram of FIG. 1. Referring to FIG. 1, the liquid crystal apparatus includes a graphic controller 1, from which data is issued and supplied via a drive control circuit 2 to a scanning signal control circuit 3 and a data signal control circuit 4 to be converted into scanning line address data and display data. These data are then supplied to a scanning electrode drive circuit 5 and a data electrode drive circuit 7 as drive circuits.

On receiving such scanning line address data, the scanning line drive circuit 5 generates, based on the scanning line address data, a scanning line selection signal and a scanning line non-selection signal which are supplied to scanning electrodes 8 (including broader electrodes 8*a* and narrower electrodes 8*b*) constituting an electrode matrix together with data electrodes 9 (including broader electrodes 9*a* and narrower electrodes 9*b*) of a display unit 6 composed of a liquid crystal device. On the other hand, on receiving the display data, the data electrode drive circuit 7 generates, based on the displayed data, data signals which are supplied to the data electrodes 9 (9*a* and 9*b*).

Based on the scanning line selection signal and the data signals applied to the scanning electrodes 8 and the data electrodes 9, respectively, the liquid crystal display unit 6 is driven to display a picture.

Figure 2:
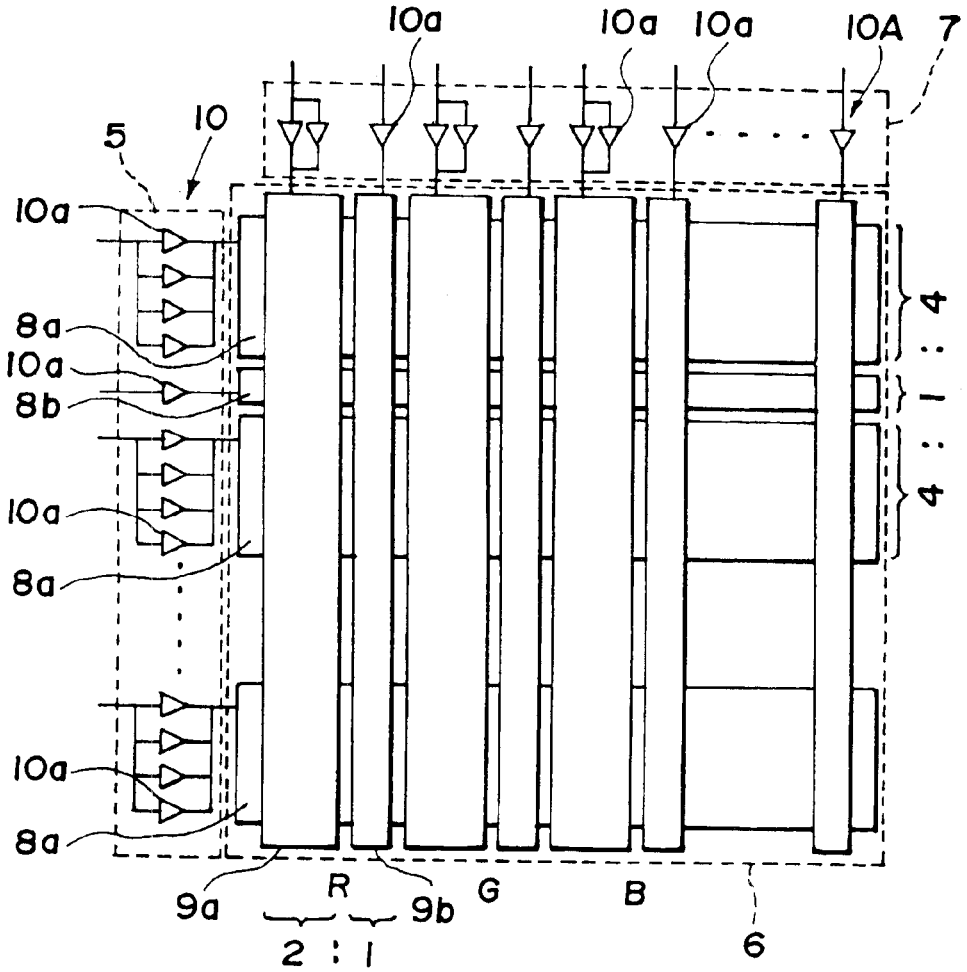
FIG. 2 is a schematic plan view for showing an electrode arrangement constituting the liquid crystal display unit shown in FIG. 1 and peripheral driver ICs for driving the display unit.

In this embodiment, the scanning electrodes 8 include broader scanning electrodes 8*a* and narrower scanning electrodes 8*b* which have a substantially equal thickness but have a width ratio (i.e., areal ratio) of 4:1 therebetween as shown in FIG. 2. Further, the data electrodes 9 include broader data electrodes 9*a* and narrower data electrodes 9*b* which have a substantially equal thickness but have a substantially equal thickness but have a width ratio (i.e., areal ratio) of 2:1 therebetween.

The scanning signal drive circuit 5 is equipped with a driver IC 10 comprising a plurality of drive signal output terminal transistors 10*a*. Now, a narrower scanning electrode 8*b* is assumed to have a resistance RS and a capacitance CS per unit length along its extension, and an output terminal transistor 10*a* for driving the electrode 8*b* is set to have a drive capacity as represented by an on-resistance Ron. On the other hand, a broader scanning electrode 8*a* is assumed to have a resistance RS/4 and a capacitance 4 CS per unit length along its extension, and an output terminal transistor 10*a* for driving the electrode 8*b* is set to have a drive capacity as represented by an on-resistance Ron/4. Then, the two types of transistor-electrode combinations are represented by equivalent circuits of FIGS. 3 and 4, respectively.

Figure 3:
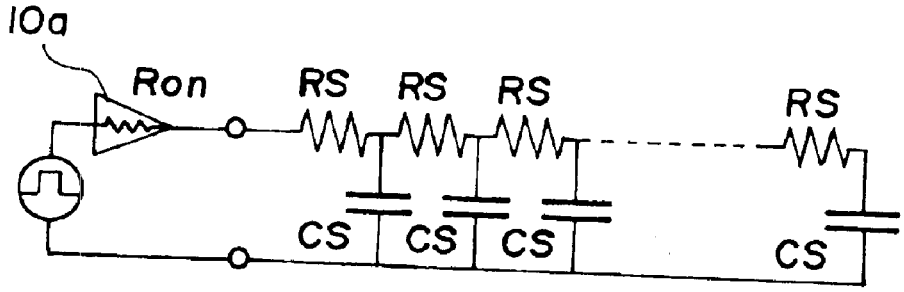
FIGS. 3 and 4 are equivalent circuit diagrams for drive of a narrower scanning electrode and a broader scanning electrode, respectively, in a matrix electrode in the liquid crystal display unit, with associated drive signal output terminals.
Figure 4:
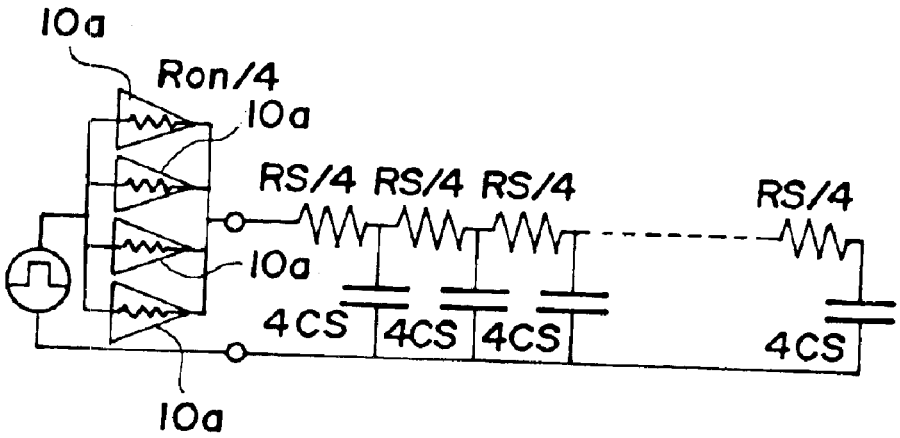
Figure 5:
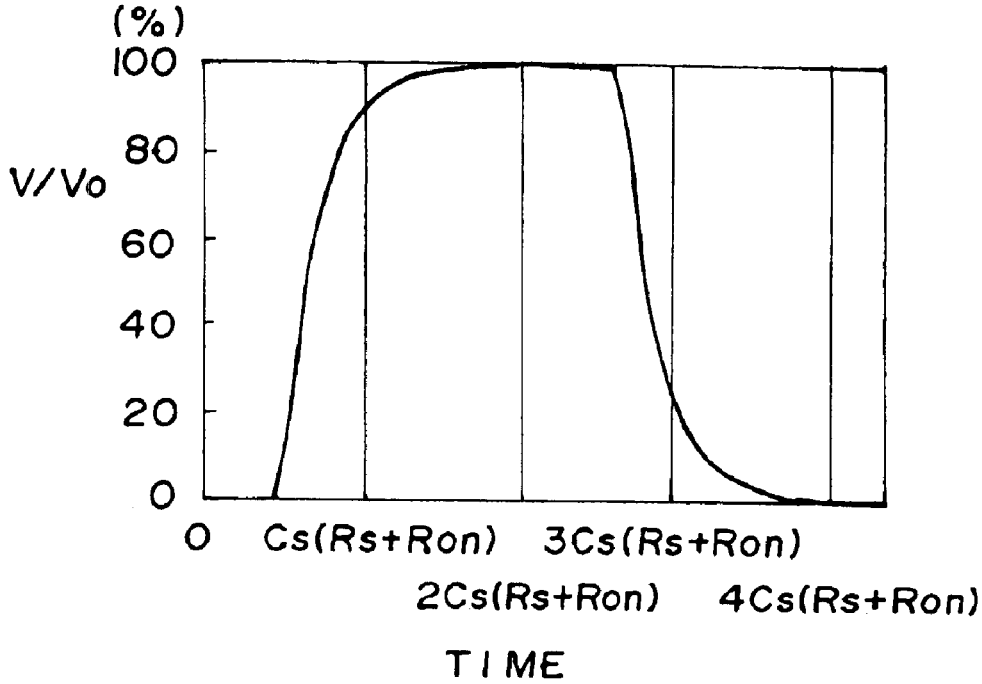
FIGS. 5 and 6 are voltage response characteristic signal waveforms at remotest panel ends according to the equivalent circuits shown in FIGS. 3 and 4, respectively.
Figure 6:
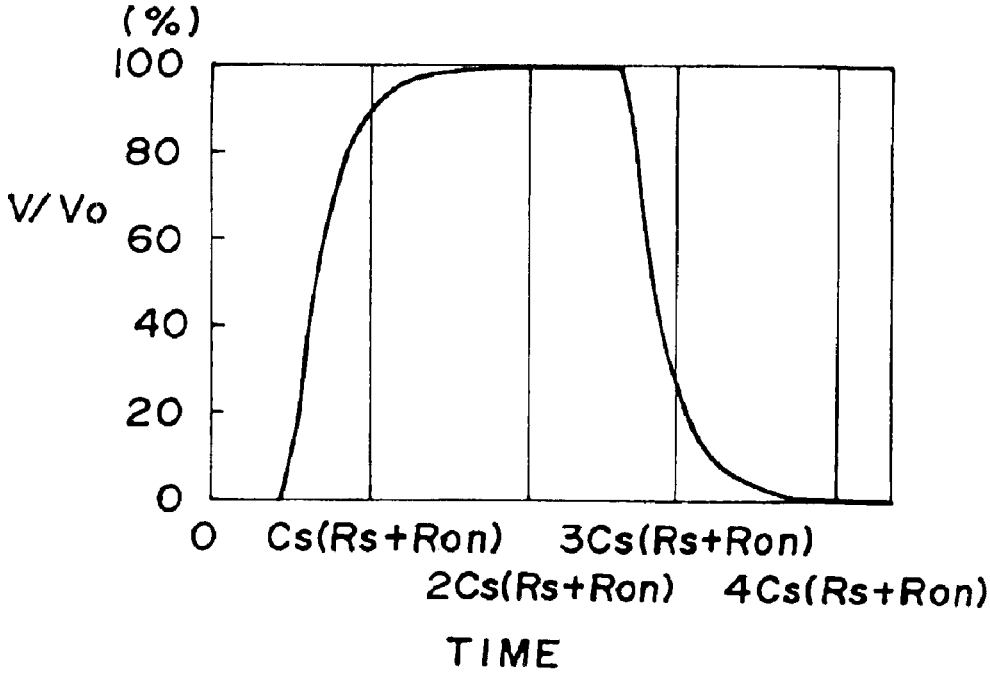

In this embodiment, as shown in FIG. 3, a narrower electrode 8*b* (more specifically a liquid crystal device along the electrode 8*b*) is driven by one transistor 10*a* in the scanning electrode drive circuit 5, but a broader electrode 8*b* is driven by 4 transistors 10*a* disposed in parallel in the scanning electrode drive circuit 5. As a result, the voltage responses (degree of voltage waveform rounding) at the ends of the respective electrodes 8*b* and 8*a* remotest from the scanning signal driver IC 10 become identical to each other as shown in FIGS. 5 and 6, respectively.

In this way, in the case of driving scanning electrodes 8*a* and 8*b* having mutually different resistances and capacitances (loads), if the drive capacities of the respective drive signal output terminals are varied depending on the resistances and capacitances of the respective electrodes 8*a* and 8*b*, more specifically, if a plurality of transistors 10*a* are juxtaposed and connected in parallel to the broader electrode 8*a* by changing the overall drive capacity (on-resistance) of the transistors to Ron/4, it becomes possible to apply an identical level of energy to the liquid crystal or liquid crystal pixels connected to electrodes having different resistances and capacitances, thus making it possible to prevent a difference in picture display quality between the pixels.

Further, it becomes possible to prevent a fluctuation in power supply potential or ground potential, occurrence of radiation noise, heat radiation and increase in current consumption at the liquid crystal display unit 6. Further, it becomes possible to provide an inexpensive driver IC having optimum output transistor sizes.

Next, a method of changing the drive capacity of drive signal output terminals is explained with reference to a driver IC including MOS transistors.

Figure 7:
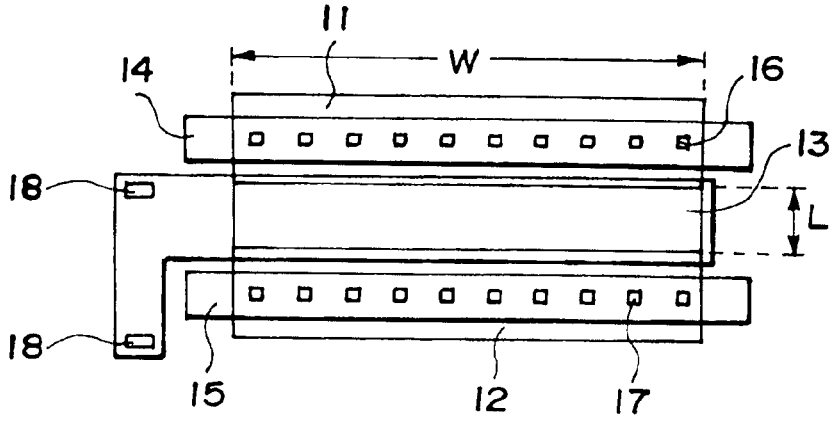
FIG. 7 is a plan view showing an ordinary planar pattern of a MOS transistor as an example of transistor included in a driver IC according to the invention.

FIG. 7 is a plan view illustrating a general physical shape of a MOS transistor including a drain diffusion layer 11, a source diffusion layer 12 and gate polysilicon 13.

A drain output is outputted to a drain aluminum wire 14 through a contact 16 between the drain electrode and the drain diffusion layer 11. Further, a source potential is supplied from a source aluminum wire 15 through a contact 17 between a source electrode and the source diffusion layer 12, and a gate signal is supplied through a contact 18 between the gate polysilicon 13 and an aluminum wire (not shown).

The on-resistance Ron of such a MOS transistor is determined by a ratio W/L between a gate width W and a gate length L, and the gate length L is determined by a required withstand voltage and a production process of the IC. Accordingly, the change in drive capacity of a MOS transistor is effected by changing the gate width W depending on the required drive capacity.

Thus, the change in drive capacity of drive signal output terminal of a driver IC may be performed by increasing or decreasing the gate width W depending on varying loads. In this embodiment, a photomask for forming the above-mentioned layers 11 and 12 of the transistor is changed to form connection wires for connecting a prescribed number of transistors.

Figure 8:
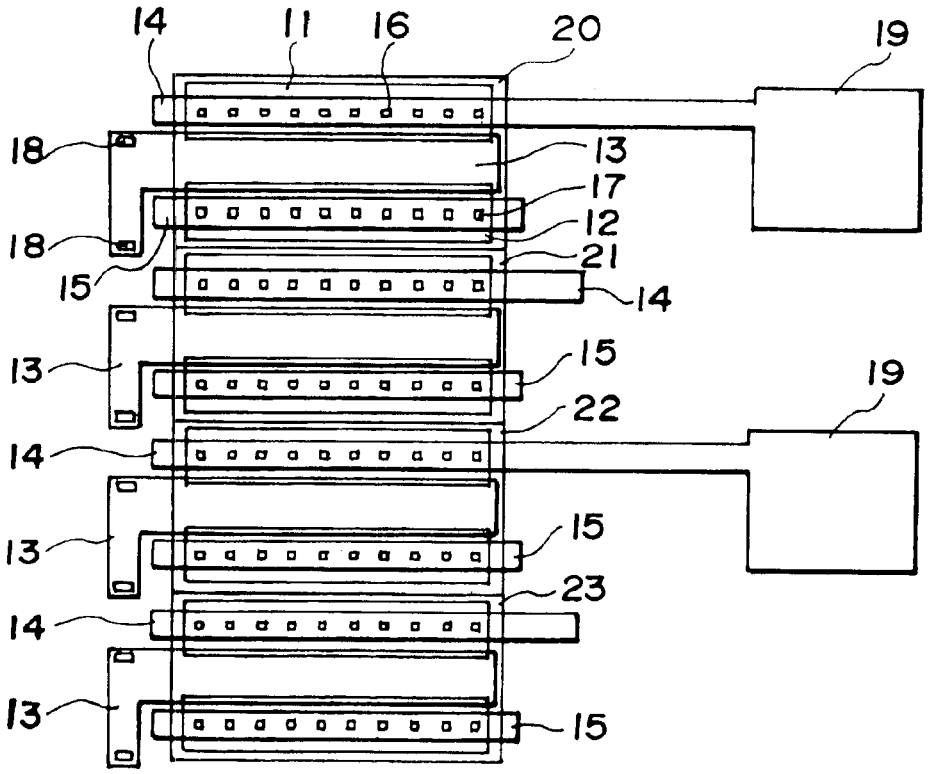
FIG. 8 is a plan view showing a basic structure of a driver IC including the MOS transistor.

FIG. 8 illustrates a basic physical shape of drive signal output terminal transistors of a driver IC of which the drive capacity is to be changed by changing a photomask for a part of the layers.

Each drive signal output terminal is generally composed of a plurality of transistors connected to respective liquid crystal drive power sources for switching between the liquid crystal drive power sources, but only one transistor is indicated as a representative of such plural transistors since they have an identical organization.

Referring to FIG. 8, numeral "19" denotes a bump or bonding pad for taking a drain output of a transistor out of an IC chip. The IC includes a first transistor 20 and a third transistor 22 of which the drain electrodes are connected to the output pads 19 via the drain aluminum wires 14. Further, second and fourth transistors 22 and 24 have drain electrodes not connected to the output pads 19. The transistors 20, 21, 22 and 23 respectively have a drive capacity Ron.

Figure 9:
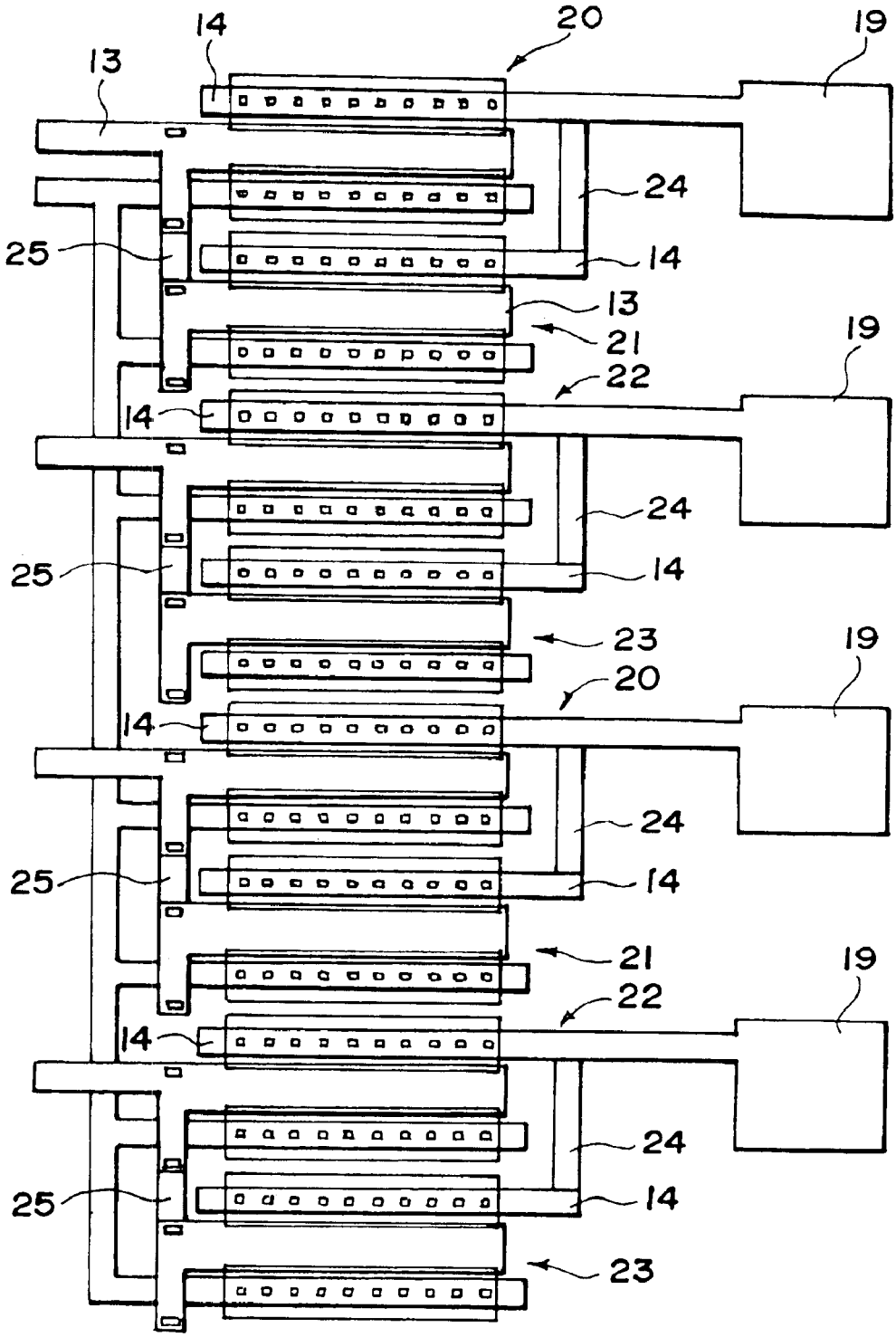
FIGS. 9–12 are plan views showing planar patterns of driver ICs according to first to fourth embodiments, respectively, of the invention.

Based on the basic structure shown in FIG. 8, as a first embodiment, drain connection switching aluminum wires 24 for connecting the drain aluminum wires 14 of the second and fourth transistors 21 and 23 to the output pads 19, and gate connection switching aluminum wires 25 for connecting the gate electrodes of the first and third transistors 20 and 22 to the gate electrodes of the second and fourth transistors 21 and 23, as shown in FIG. 9, are additionally formed by changing a photomask pattern (not shown) for forming the drain aluminum oxides 14.

By additionally forming the drain connection switching aluminum wires 24 and the gate connection switching aluminum wires 25, it becomes possible to realize a driver IC having drive signal output terminals each having a uniform drive capacity of Ron/2. Thus, by changing only a pattern of photomask for forming aluminum layers for a driver IC, it is possible to easily realize a driver IC having drive signal output terminals having uniform drive capacities of Ron/2.

Figure 10:
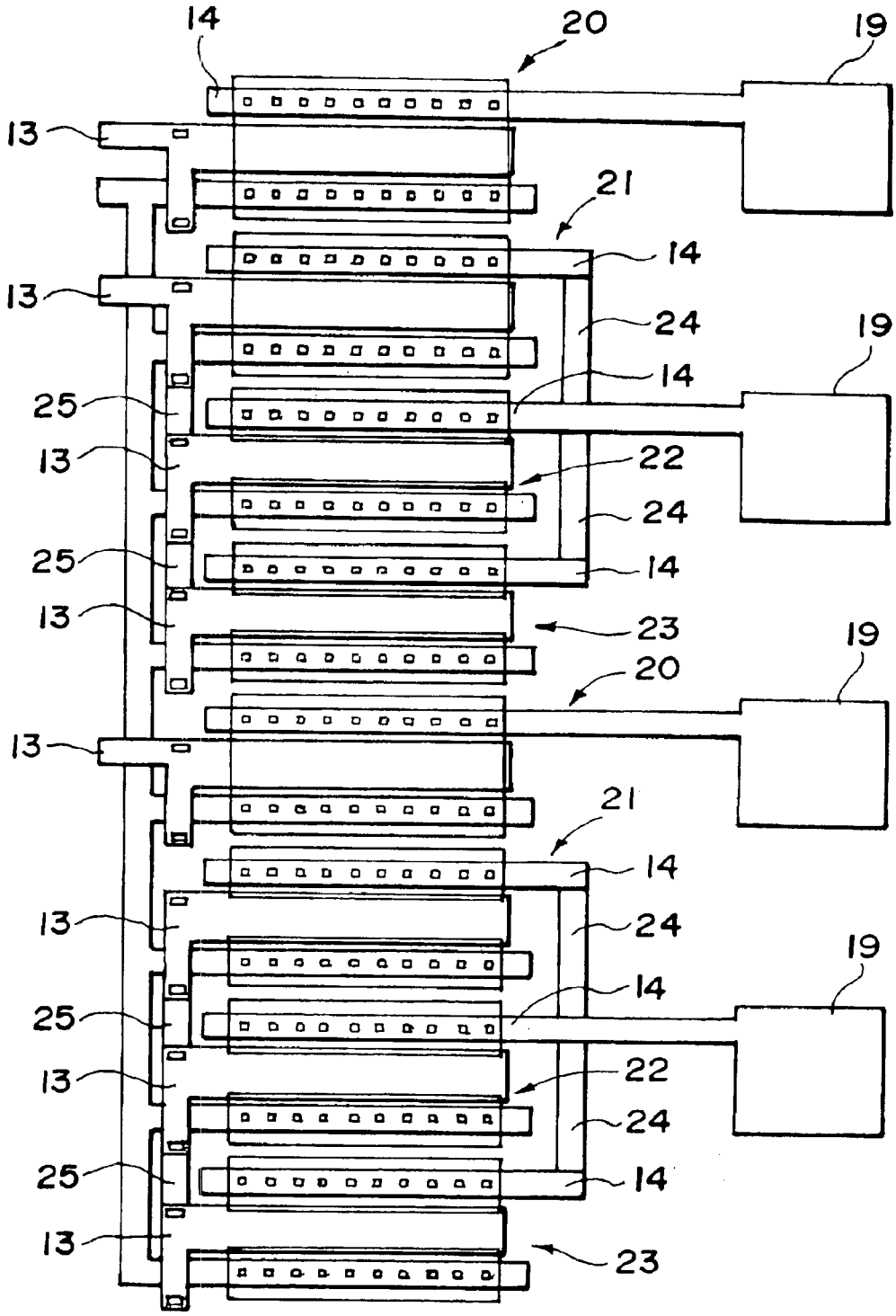

Further, as a second embodiment starting again from the basic structure shown in FIG. 8, drain connection switching aluminum wires 24 for connecting the drain aluminum wires of the second and fourth transistors 21 and 23 to one output pad 19, and gate connection switching aluminum wires 25 for connecting the gate electrode of the third transistor 22 to the gate electrodes of the second and fourth transistors 21 and 23, as shown in FIG. 10, are additionally formed by changing a photomask pattern (not shown) for forming the drain aluminum wires 14. As a result, it becomes possible to realize a driver IC having a plurality of drive signal output terminals having drive capacities of Ron and Ron/3 alternately.

Figure 11:
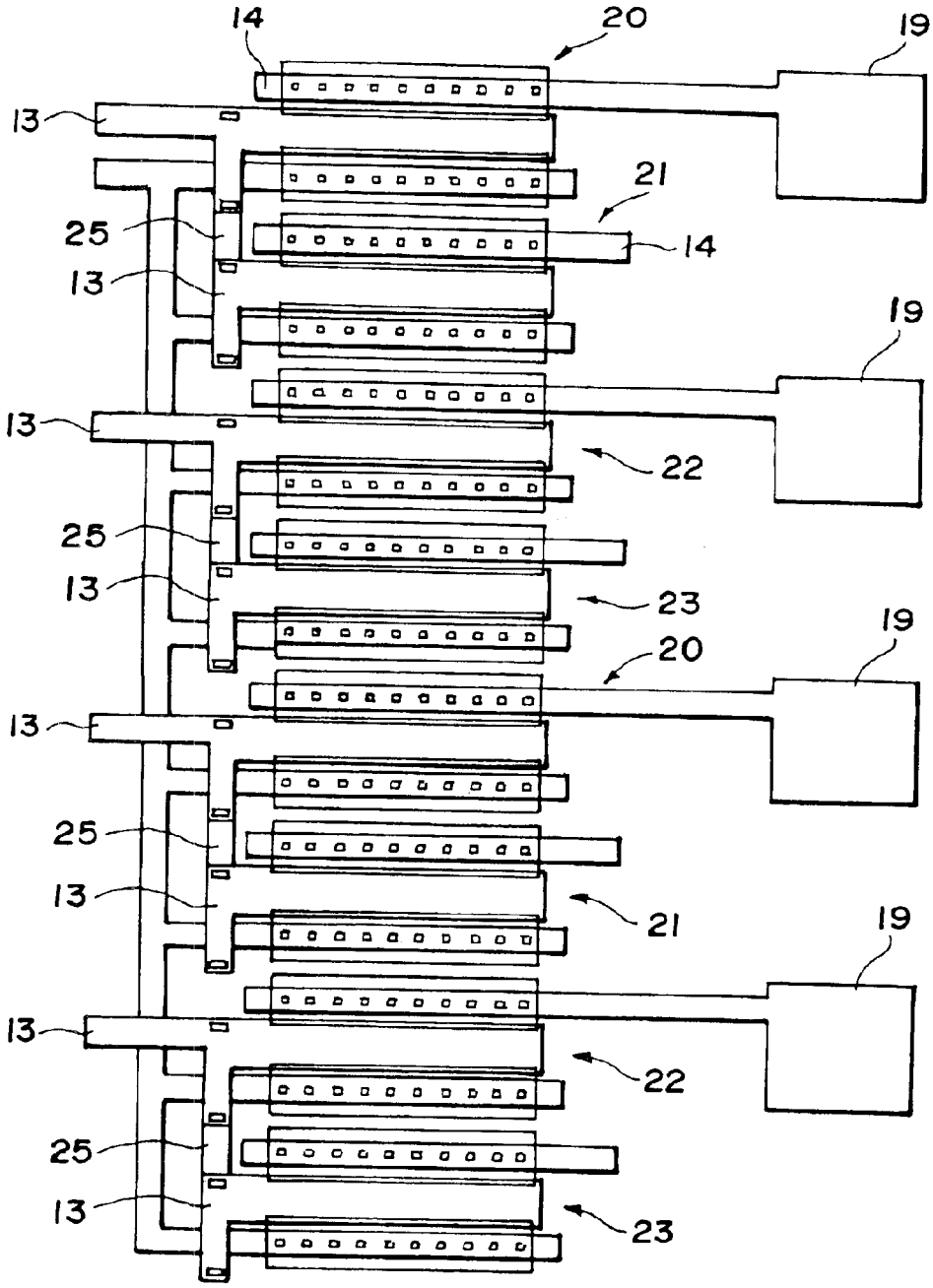

As a third embodiment, starting again from the basic structure shown in FIG. 8, gate connection switching aluminum wires 25 as shown in FIG. 11 are additionally formed by changing a photomask pattern (not shown) for forming the drain aluminum wire 14 so as to realize a driver IC having all drive signal output terminals uniformly having a drive capacity Ron.

Figure 12:
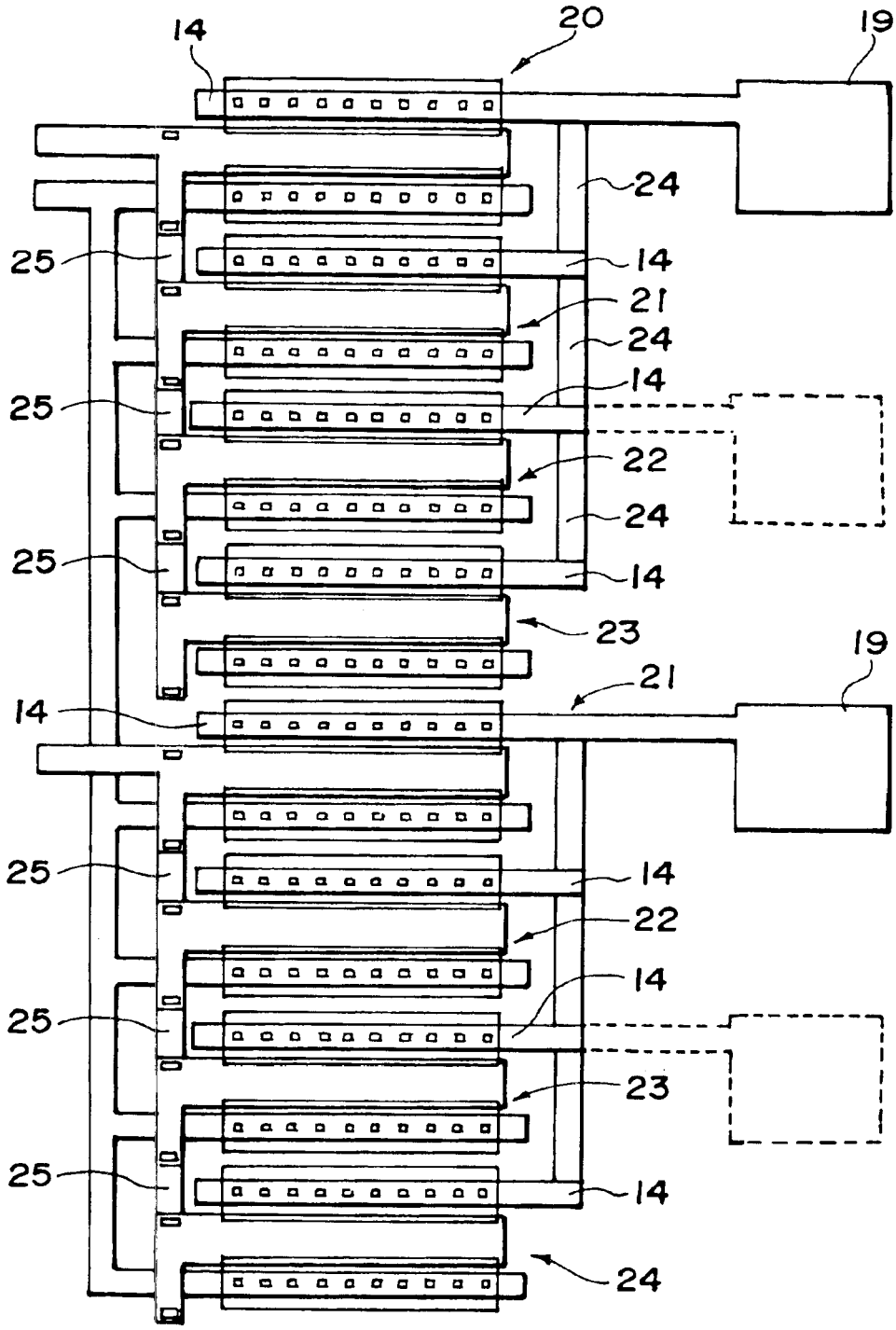

As a fourth embodiment, starting again from the basic structure shown in FIG. 8, drain connection switching aluminum wires 24 and gate connection switching aluminum wires 25 are additionally formed by changing the photomask pattern for forming the drain aluminum wires 14, and the number of output pads 19 is reduced to a half by changing a photomask pattern for forming a passivation film providing output pad apertures as shown in FIG. 12, so as to realize a driver IC having a half number of output terminals each having a drive capacity of Ron/4.

Figure 13:
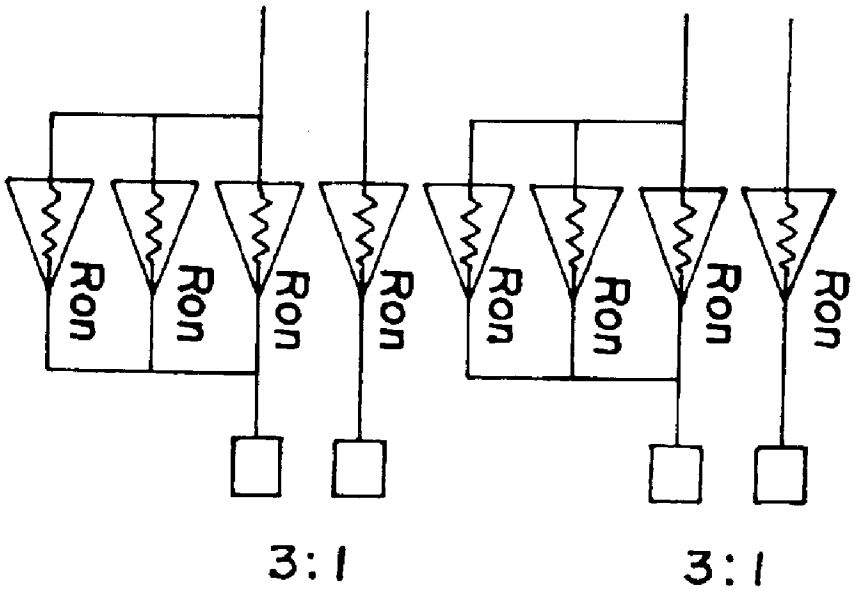
FIG. 13 is an equivalent circuit diagram for the driver IC according to the second embodiment (FIG. 10).

FIG. 13 shows an equivalent circuit for the driver IC shown in FIG. 10. In FIG. 13, "3:1" represents a drive capacity ratio (as a reciprocal of on-resistance ratio).

When four transistors each having a drive capacity of Ron are used in combination as in the above-described embodiments, it is possible to have output terminals having three drive capacity ratios of 1:1, 1:2 and 1:3.

Figure 14:
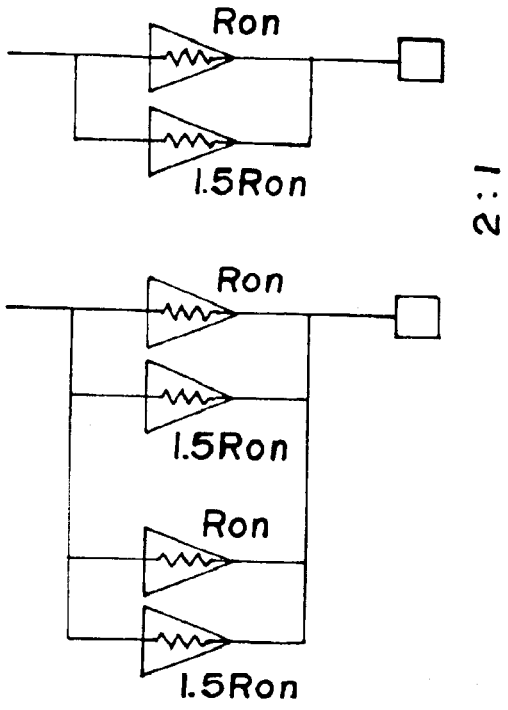
FIGS. 14 and 15 are equivalent circuit diagrams of driver ICs (fifth and sixth embodiments) including transistors of different drive capacities according to different connections.
Figure 15:
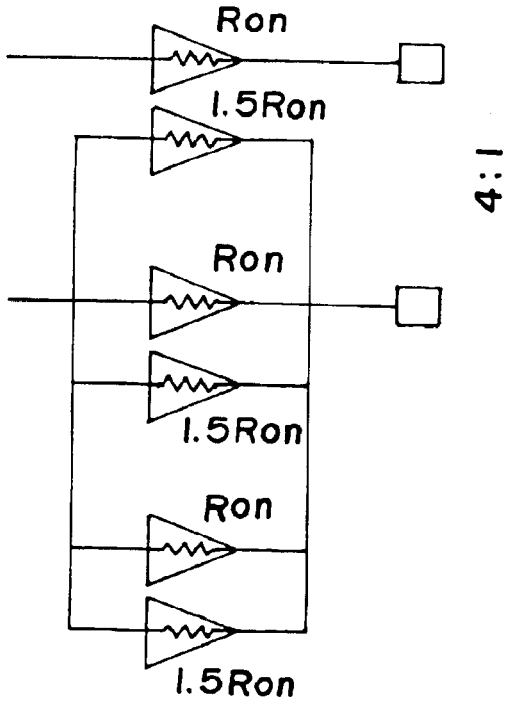
Figure 16:
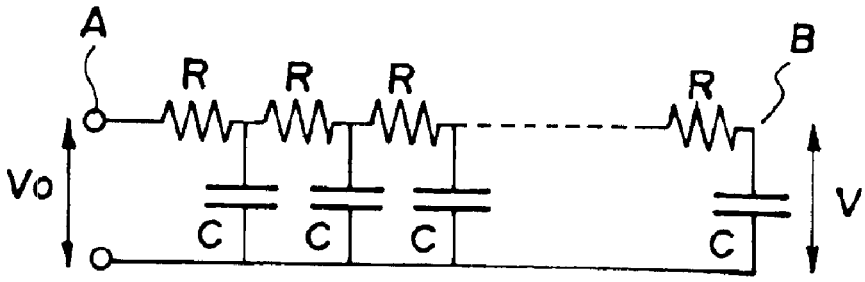
FIG. 16 is an equivalent circuit diagram for conventional drive of a liquid crystal device along a signal electrode.
Figure 17:
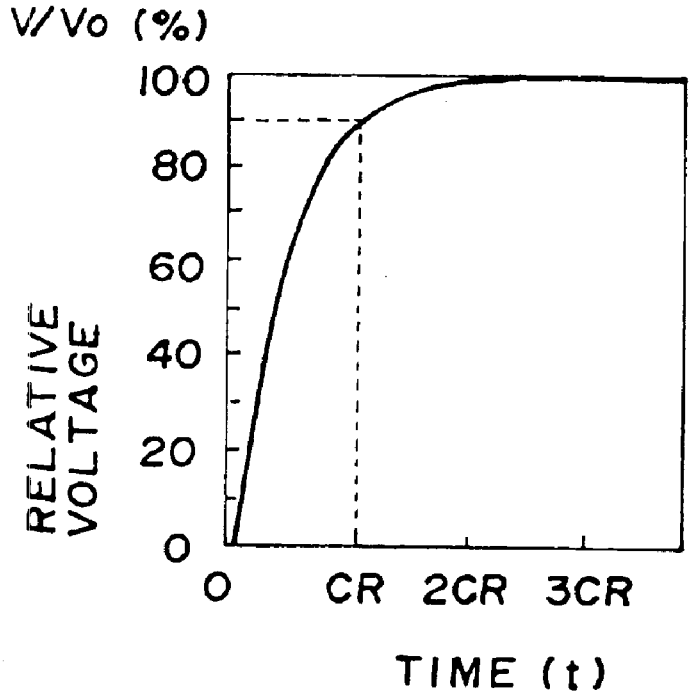
FIG. 17 is a drive voltage response characteristic curve at a remotest electrode end (at B point) of the equivalent circuit shown in FIG. 16.
Figure 18:
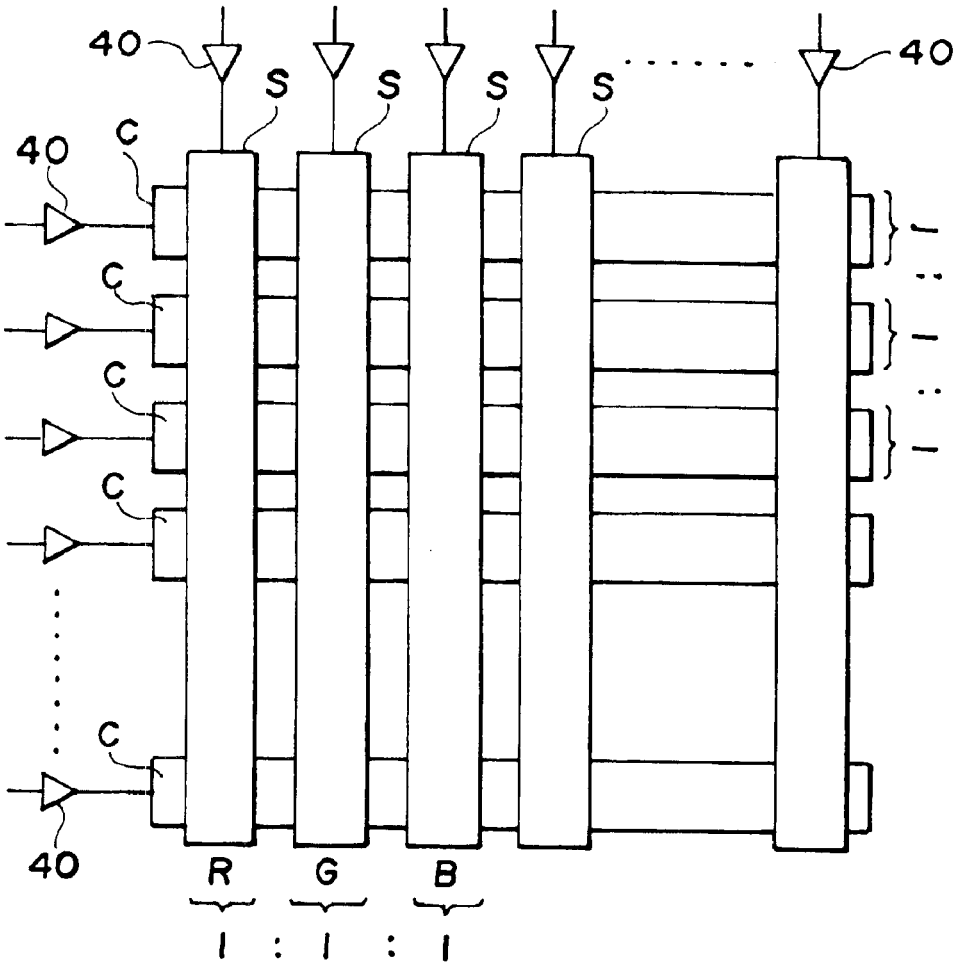
FIG. 18 is a plan view showing a conventional electrode matrix of a liquid crystal device.
Figure 19:
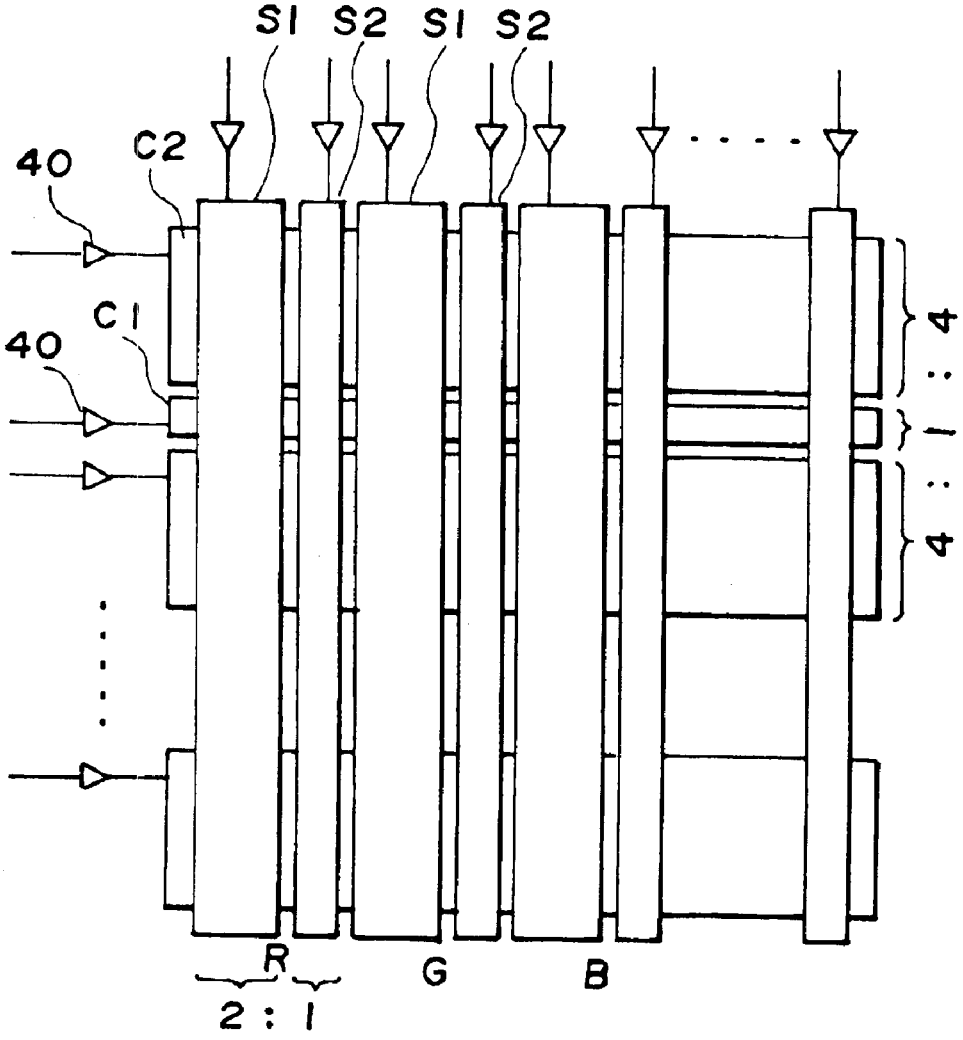
FIG. 19 is a plan view showing a conventional electrode matrix including signal electrodes having different widths.
Figure 20:
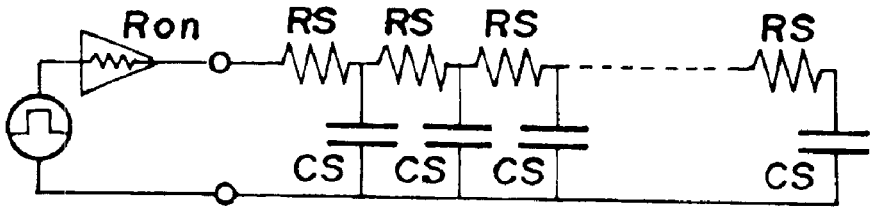
FIGS. 20 and 22 are equivalent circuit diagrams for drive of a liquid crystal device along a narrower scanning electrode and a broader scanning electrode, respectively, in the electrode matrix shown in FIG. 19.
Figure 21:
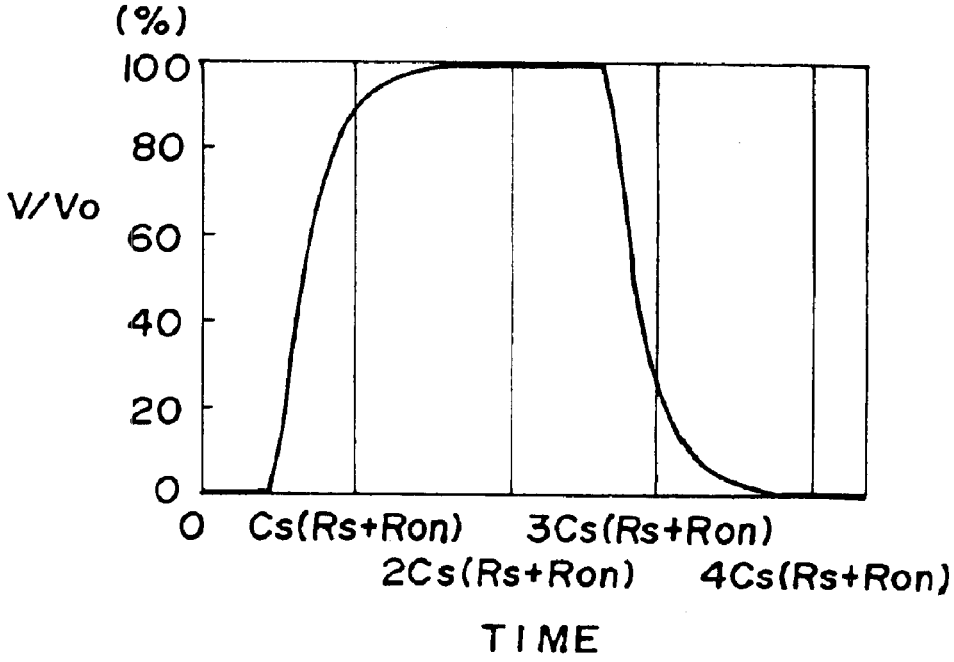
FIGS. 21 and 23 show drive voltage response characteristics obtained by the circuits shown in FIGS. 20 and 22, respectively.
Figure 22:
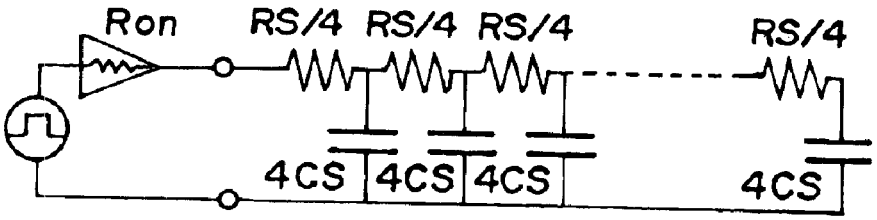
Figure 23:
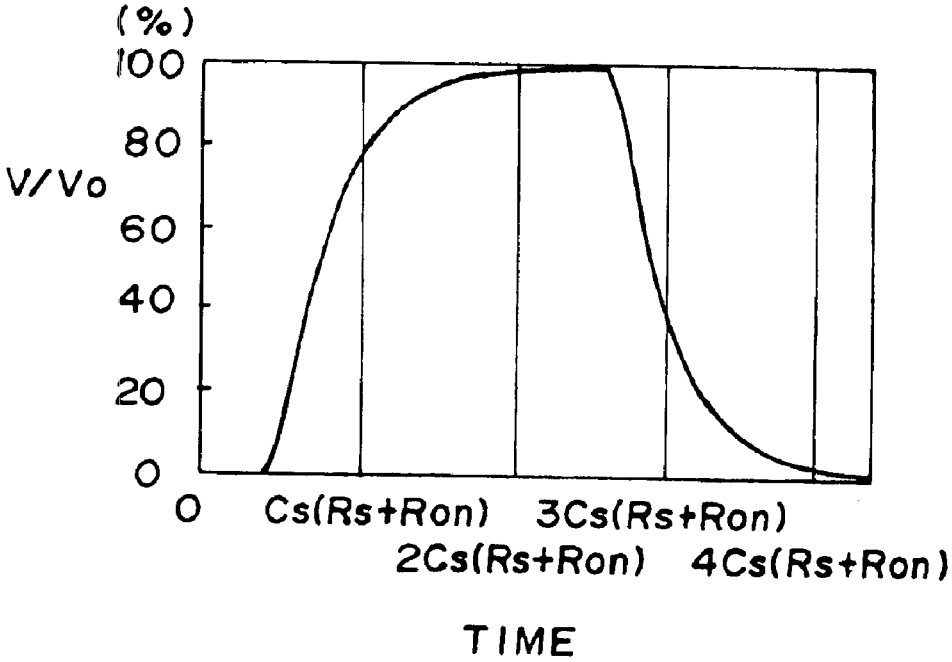

On the other hand, FIGS. 14 and 15 show equivalent circuits giving different drive capacity ratios of 2:1 and 4:1 by combination of 6 transistors having drive capacities of Ron and 1.5 Ron.

The above description has been made as embodiments for modifying the output terminal drive capacities of a driver IC 10 contained in a scanning electrode drive circuit 5, but similar embodiments are given for modifying the output terminal drive capacities of a driver IC 10A in a data electrode drive circuit 7 (as shown in FIG. 2).

In the above embodiments, the photomask pattern changes for the aluminum layer and the passivation layer have been used for changing the drive capacities of the drive signal output terminals. In the present invention, it is also possible to accomplish similar effects by changing the photomask patterns for the gate polysilicon, the drain diffusion layer 11 and the source diffusion layer 12.

Figure 24:
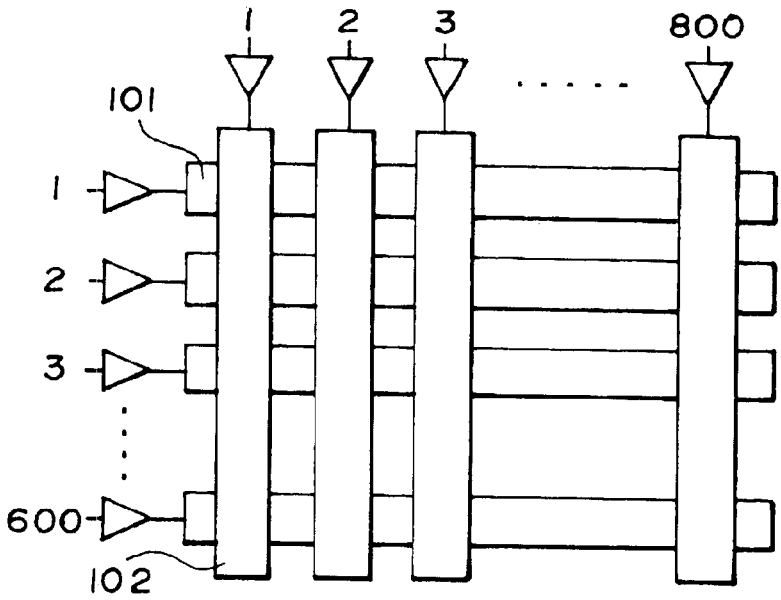
FIGS. 24 and 25 are plan views showing electrode matrixes for a 12-inch SVGA panel and a 15-inch XGA panel, respectively.
Figure 25:
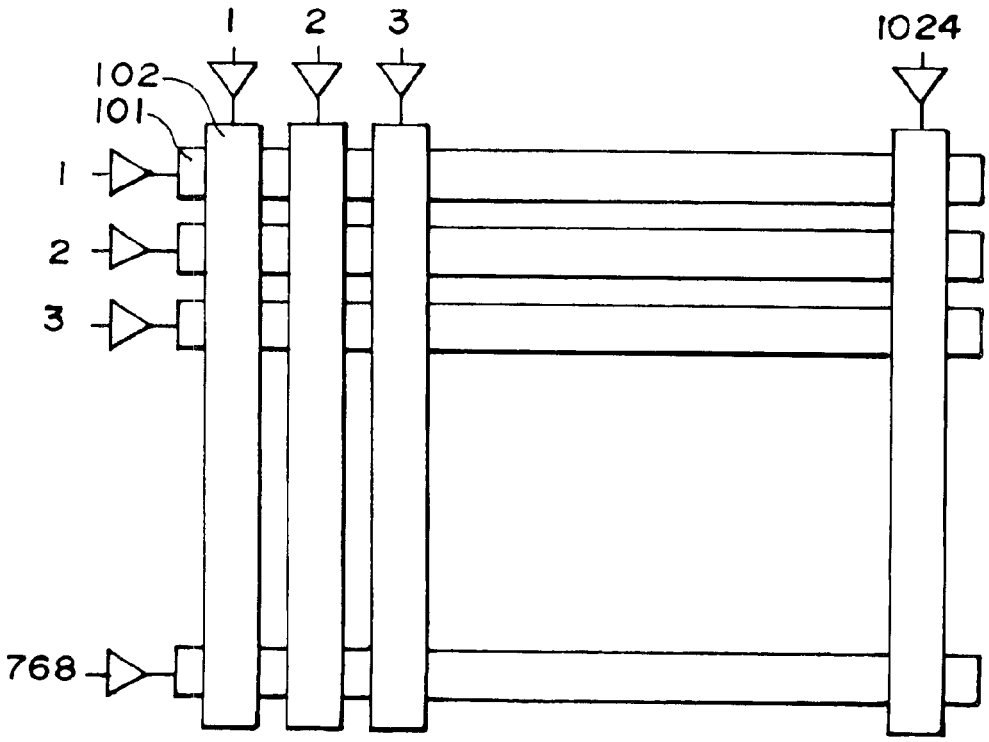

As a further embodiment, FIGS. 24 and 25 are schematic plan views showing electrode structure for a 12-inch SVGA-grade display (600×800 pixels) and a 15-inch XGA-grade display (768×1024 pixels), each including a matrix of scanning electrodes 101 and data electrodes 102.

The respective displays have the following dimensions.

| | 12-inch SVGA (FIG. 24) | 15-inch XGA (FIG. 25) |
|---|---|---|
| Panel size | | |
| vertical | 180 mm | 230 mm |
| lateral | 234 mm | 300 mm |
| Data electrode resistance | 150 ohm | 192 ohm |
| Scanning electrode resistance | 200 ohm | 200 ohm |

-continued

| | 12-inch SVGA (FIG. 24) | 15-inch XGA (FIG. 25) |
|---|---|---|
| Scanning electrode width | 100 μm | 128 μm |
| Cell gap | 5 μm | 5 μm |
| Permittivity | $8.855 \times 10^{-12}$ | $8.855 \times 10^{-2}$ |
| Dielectric constant | 4 | 4 |

Then, the capacitance of each data electrode for the 12-inch SVGA panel ($C_{12}$) is calculated as follows:

$$C_{12} = (8.855\times10^{-12})\times4\times(180\times10^{-3})\times234\times10^{-3}/800/5\times10^{-6}$$
$$= 370\times10^{-12}F$$

Similarly, the capacitance of each data electrode for the 15-inch XGA panel is calculated as follows:

$$C_{15} = (8.855\times10^{-12})\times4\times(230\times10^{-3})\times(300\times10^{-3})/1024/5\times10^{6}$$
$$= 1.28\times370\times10^{-12}F$$

Figure 26:
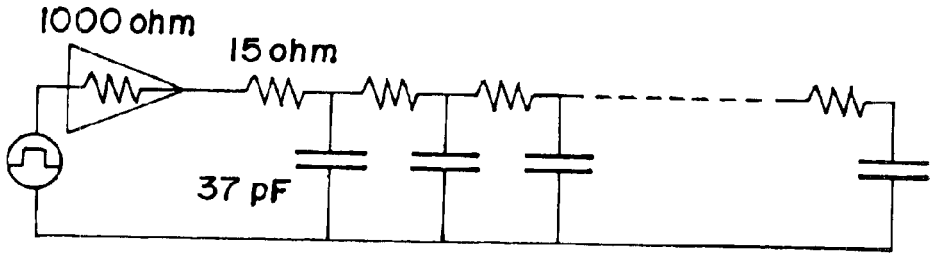
FIGS. 26 and 28 are equivalent circuit diagrams for drive of the panels shown in FIGS. 24 and 25, respectively, along a data electrode, thereof.

Accordingly, the drive of each data electrode in the 12-inch SVGA panel by a driver IC having an on-resistance of 1000 ohm can be represented by an equivalent circuit shown in FIG. 26.

Figure 27:
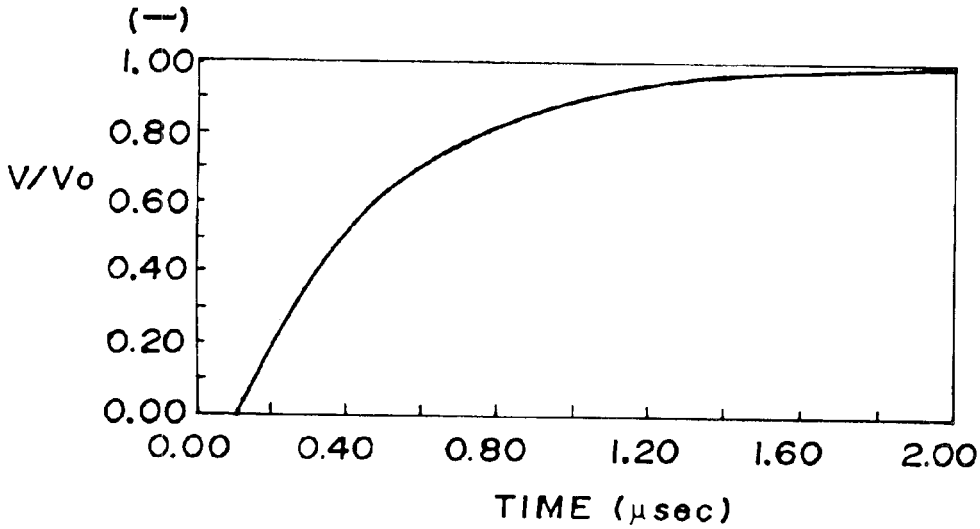
FIGS. 27 and 29 show drive voltage response characteristics obtained by the circuits shown in FIGS. 26 and 28, respectively.

A transient analysis of the equivalent circuit when supplied with a step input of 1 volt ($V_0$=1 volt) from a time t=0.1 μsec was performed by an SPIC simulator, whereby an output response ($V/V_0$) at the panel terminal shown in FIG. 27 was attained. FIG. 27 shows that a response rise of 0–90% requires ca. 0.9 μsec.

Figure 28:
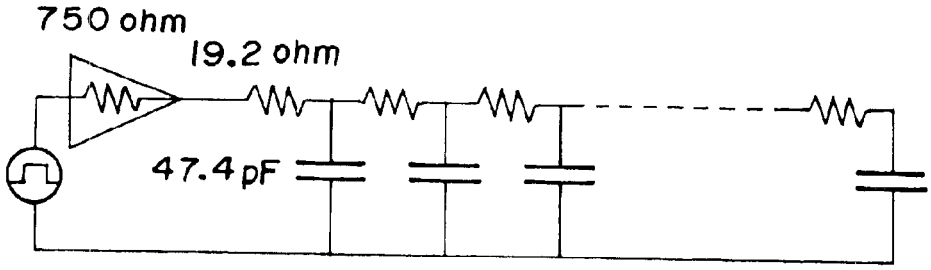
Figure 29:
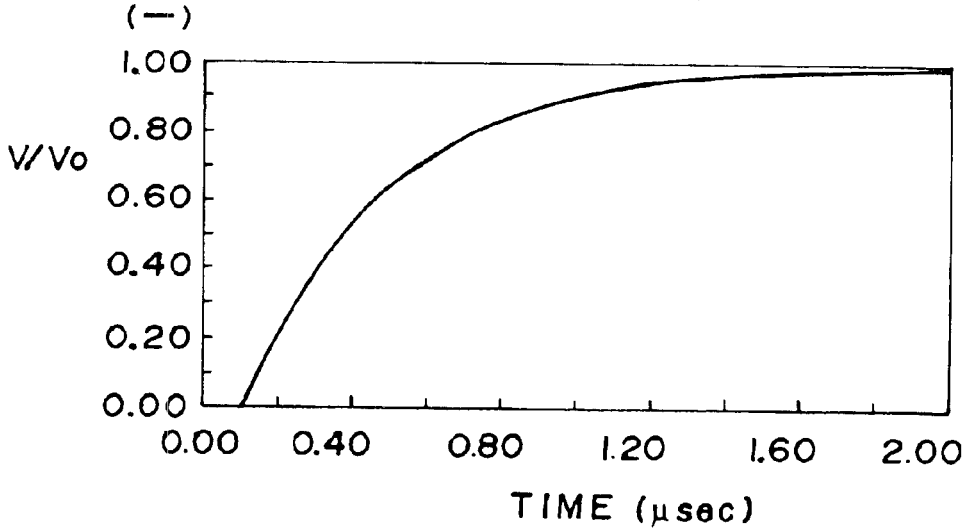

On the other hand, the drive of each data electrode in the 15-inch XGA panel by driver IC having an on-resistance of 750 ohm and the output response ($V/V_0$) characteristic thereof are shown in FIGS. 28 and 29, respectively.

As the electrode size is multiplied by 1.28 times for the length, the resistance becomes 1.28 times that in the 12-inch SVGA panel and the capacitance also becomes 1.28 times. The response curve (FIG. 29) shows that a 0–90% response requires ca. 0.9 μsec.

In the above embodiment, a driver IC capacity change for a data electrode 102 has been described, but a driver IC capacity change for a scanning electrode 101 can also be effected.

Conventionally, two matrix panels formed of identical wire materials and cell gap but having different panel sizes have been driven by driver ICs designed and developed depending on the loads of the panel. According to the present invention, however, it has become possible to provide a driver IC adaptable to a 12-inch SVGA panel and a 15-inch XGA panel by changing the drive capacities. Such drive capacity change of a driver IC depending on a change in panel load corresponding to a panel size increase can be performed by changing only the photomask pattern so that a new driver IC designing becomes unnecessary, the period for development can be shortened and a lowering in production cost can be achieved.

The display device according to the present invention is not restricted to a liquid crystal device as shown in FIG. 30 but can also be applied to an electron discharge device and a plasma-addressed display (PDP) as described in JP-A 5-41166. Examples of the electron discharge device include a surface-conductive type electron discharge device described in JP-A 64-31332 and an FE-type device described in U.S. Pat. No. 4,904,895.

As described, according to the present invention, the energies applied to an liquid crystal disposed along electrodes having different loads can be made identical by changing the drive capacity of drive signal output terminals (such as driver ICs) depending on the loads of the electrodes connected to the drive signal output terminals, thereby preventing the occurrence of picture display quality differences.

Further, it is possible to prevent the occurrence of changes in power supply potential and ground potential of a display device, radiation noise heat generation and increase in current consumption. Further, the drive capacity change of a drive signal output terminal can be effected by a change of photomask pattern, so that the design and production of a driver IC become simpler to realize a lower cost production.

What is claimed is:

1. A driver IC (integrated circuit) for supplying drive signals to a plurality of signal electrodes arranged in one display device for driving the display device, wherein said driver IC comprises a plurality of drive signal output terminals having drive capacities which vary depending on loads of respective signal electrodes of the display device to which the output terminals are connected, so as to supply the respective signal electrodes arranged in one display device with drive signal waveforms having an identical time constant.

2. A driver IC for supplying drive signals to a plurality of signal electrodes arranged in one display device for driving the display device, wherein said driver IC comprises a plurality of drive signal output terminals arranged to have variable drive capacities which vary depending on loads of respective signal electrodes of the display device to which the output terminals are connected, so as to supply the respective signal electrodes arranged in one display device with drive signal waveforms having an identical time constant.

3. The driver IC according to claim 2, wherein the load of each signal electrode comprises a resistance of the signal electrode and capacitances of liquid crystal pixels formed along the signal electrode, and the display device comprises liquid crystal pixels having different capacities.

* * * * *

UNITED STATES PATENT AND TRADEMARK OFFICE

CERTIFICATE OF CORRECTION

PATENT NO. : 6,909,416 B2
DATED : June 21, 2005
INVENTOR(S) : Tadashi Aoki

It is certified that error appears in the above-identified patent and that said Letters Patent is hereby corrected as shown below:

Column 1,
Line 62, “logarithm” should read -- logarithms --.

Column 2,
Line 25, “diver” should read -- driver --.

Column 3,
Line 22, “there” should read -- they --;
Line 66, “arrange” should read -- arranged --.

Column 5,
Line 36, “illuminate” should read -- illuminated --.

Column 10,
Line 16, “an” should read -- a --.

Signed and Sealed this

Third Day of January, 2006

JON W. DUDAS
*Director of the United States Patent and Trademark Office*